US007950309B2

(12) United States Patent
Junkers et al.

(10) Patent No.: US 7,950,309 B2
(45) Date of Patent: May 31, 2011

(54) POWER-DRIVEN TORQUE INTENSIFIER

(75) Inventors: John K Junkers, Saddle River, NJ (US); Peter Koppenhoefer, Portland, PA (US); Calin Voicu, Wayne, NJ (US); Neil Smith, New Milford, NJ (US); Edward Kim, Palisades Park, NJ (US)

(73) Assignee: Unex Corporation, Mahwah, NJ (US)

( * ) Notice: Subject to any disclaimer, the term of this patent is extended or adjusted under 35 U.S.C. 154(b) by 0 days.

(21) Appl. No.: 11/745,014

(22) Filed: May 7, 2007

(65) Prior Publication Data

US 2007/0251359 A1 Nov. 1, 2007

Related U.S. Application Data

(63) Continuation-in-part of application No. 11/414,702, filed on Apr. 28, 2006, now abandoned.

(51) Int. Cl.
*B25B 21/00* (2006.01)
*B25B 13/48* (2006.01)
*B25B 17/02* (2006.01)

(52) U.S. Cl. ..... 81/55; 81/57.42

(58) Field of Classification Search ..... 81/55, 56, 81/57.11, 57.42, 436, 53.2; 475/298–300; 74/15.86

See application file for complete search history.

(56) References Cited

U.S. PATENT DOCUMENTS

| | | | | |
|---|---|---|---|---|
| 2,569,244 A | | 9/1951 | Larson | |
| 3,942,398 A | * | 3/1976 | Fletcher et al. | 81/56 |
| 4,431,062 A | * | 2/1984 | Wanner et al. | 173/104 |
| 4,513,827 A | | 4/1985 | Dubiel | |
| 4,574,657 A | * | 3/1986 | Asfar | 475/270 |
| 4,650,007 A | * | 3/1987 | Fujita et al. | 173/178 |
| 4,757,727 A | * | 7/1988 | Teraoka et al. | 475/85 |
| 4,966,057 A | | 10/1990 | Koppatsch | |
| 4,991,473 A | | 2/1991 | Gotman | |
| 5,083,989 A | * | 1/1992 | Yates et al. | 475/248 |
| 5,238,461 A | * | 8/1993 | Gotman | 475/248 |
| 5,277,085 A | | 1/1994 | Tanimura et al. | |
| 5,354,246 A | * | 10/1994 | Gotman | 475/248 |
| 5,399,129 A | * | 3/1995 | Ciolli | 475/301 |
| 5,490,439 A | * | 2/1996 | Matsumura et al. | 81/469 |
| 5,540,629 A | * | 7/1996 | Gotman | 475/248 |
| 5,692,575 A | * | 12/1997 | Hellstrom | 173/216 |

(Continued)

FOREIGN PATENT DOCUMENTS

DE 33 26 591 1/1985

(Continued)

*Primary Examiner* — David B Thomas
(74) *Attorney, Agent, or Firm* — Michael J. Striker

(57) ABSTRACT

A torque intensifying tool for tightening and loosening threaded connectors has at least one torque intensifier unit with a torque intensifier housing portion, an input and a first output and a second output, a drive connected with the input unit for transmitting a torque from the drive through the intensifying unit to a threaded connector, so that in one mode of operation the housing portion together with the first and the second outputs turn in the same direction, and in another mode of operation the housing portion together with one of the first and second outputs receives a turning force in one direction while the other one of the first and second outputs receives an equal turning force in the opposite direction, and so that one of the first and second output means turns in the one mode and in the another mode while the other of the first and second output means turns in the one mode and reacts in the another mode.

16 Claims, 6 Drawing Sheets

U.S. PATENT DOCUMENTS

| | | | | |
|---|---|---|---|---|
| 5,816,121 | A * | 10/1998 | Yoshimizu et al. | 81/469 |
| 5,953,965 | A * | 9/1999 | Kaneyama et al. | 81/55 |
| 6,058,810 | A * | 5/2000 | Junkers | 81/56 |
| 6,230,589 | B1 * | 5/2001 | Junkers | 81/57.39 |
| 6,401,572 | B1 * | 6/2002 | Provost | 81/57.14 |
| 6,487,940 | B2 * | 12/2002 | Hart et al. | 81/57.14 |
| 6,810,571 | B1 * | 11/2004 | Junkers | 29/452 |
| 7,093,668 | B2 * | 8/2006 | Gass et al. | 173/2 |
| 2002/0096020 | A1 | 7/2002 | Hart et al. | |
| 2003/0196824 | A1 * | 10/2003 | Gass et al. | 173/131 |
| 2006/0000624 | A1 * | 1/2006 | Hara et al. | 173/48 |
| 2006/0037766 | A1 * | 2/2006 | Gass et al. | 173/20 |
| 2006/0054333 | A1 * | 3/2006 | Duesselberg et al. | 173/201 |
| 2007/0023196 | A1 * | 2/2007 | Hara et al. | 173/48 |

FOREIGN PATENT DOCUMENTS

| | | |
|---|---|---|
| DE | 39 20 471 | 9/1990 |
| EP | 0 302 244 | 2/1989 |
| EP | 1 000 711 | 5/2000 |
| GB | 2 191 128 | 12/1987 |
| JP | 2002-254330 | 9/2002 |
| RU | 2 154 709 | 8/2000 |

* cited by examiner

POWER-DRIVEN TORQUE INTENSIFIER

CONTINUATION-IN-PART APPLICATION

This is a continuation-in-part application of application Ser. No. 11/414,702 filed on Apr. 28, 2006 now abandoned.

BACKGROUND OF THE INVENTION

The present invention relates to a torque intensifying tool.

In tightening fasteners, once the nut hits the flange surface the turning degree to tighten it up is very little. What the customer wants, on the other hand, is high turning speed so that a nut can be run down or off very fast.

The usual impact wrenches, which provide a high run down and run off speed, have the disadvantage that they are not very accurate and very slow once the nut hits the flange face. Torque power tools are torque accurate, but relatively slow in run up and run down of fasteners. Yet, still they are faster than impact guns once the nut is turned on the flange face. Torque power tools usually have an air, electric or hydraulic motor. It turns gears, which reduce the speed but increases the relatively low torque output of the motor. The higher the torque, the larger the gear ratio and obviously the slower the speed with which the nut is turned. It is, therefore, common to have a two speed mechanisms; one for run down and run off and one for the final higher torque.

It is known that running a nut down takes usually less torque than running it off due to possible thread corrosion when loosening a nut. This means that the torque derived by means of an air motor used for smaller air wrenches might have to be increased with a small intensifier to increase the turning torque provided by the motor without lowering the run up and run off speed too much. For most hand held torque power tools where the motor housing is independent to the gear housing it becomes important that the free motor-turning torque does not exceed the hand torque resistance or the tool's motor housing can not be held and starts spinning in the hand.

There are many motor driven torque multipliers in the market and some of them have two speed mechanisms, some of them react on the bolt tip, others with a reaction arm. What they all have in common is that no matter what torque or speed is applied by them their gear housing turns in the opposite direction to the output shaft. None provides a run down or run off speed where the entire gear housing together with the inner gear assembly and the output drive turn at the same high speed in the same direction.

There are also portable power driven tools in the market such as disclosed in U.S. Pat. No. 2,569,244 where a push of the tool onto the fastener increases or decreases the air inlet and thus the torque output. There is, however, none in the market where a push onto the fastener changes from turning the gear housing, its gears and its output shaft in the same direction at the same speed to applying a turning force to the gears and the output shaft in one direction and simultaneously an opposite turning force to the gear housing. There are also portable power driven tools in the market where the torque of the motor can be reduced to increase the motor speed and thus the speed of the tool.

Also, the two speed mechanism of motor driven torque multipliers usually works in a way that one or several planet gear stages are disconnected so that merely the remaining ones function. This reduces the gear ratio to obtain a higher speed and lower torque and so that once the nut stalls out all planet gear stages become functional to achieve the higher torque at a lower speed. Nevertheless, the housing still wants to react in the opposite direction to the turning direction of the gears in low ratio and high ratio. In other words, while the drive and the gears receive a turning force in one direction, the housing receives the same turning force in the opposite direction. The problem with that is that a high speed, the gears and the output shaft turn so fast in the gear housing that almost all turning parts require bearings, which makes the tool larger and heavier.

SUMMARY OF THE INVENTION

Accordingly, it is an object of the present invention to provide a torque intensifying tool which eliminates the disadvantage of the prior art.

The torque intensifying tool in accordance with the present invention is based on the idea to stop the usual equal, simultaneous but opposite turning of action and reaction when high nut turning speed is required so as to avoid that almost all turning parts require bearings.

In keeping with these objects and with others which will become apparent hereinafter, one feature of the present invention resides, briefly stated, in a torque intensifying tool for tightening and loosening threaded connectors, comprising torque intensifier means having a torque intensifier housing portion, having input means and having a first output means and a second output means; a drive operatively connected with said input means for transmitting a torque from said drive through said intensifying means to a threaded connector, so that in one mode of operation when the fastener is subjected to a relatively low turning friction said torque intensifier housing portion together with said first and said second output means turn in the same direction and the same speed and torque as said input means, and in another mode of operation when the fastener is subjected to a relatively high turning friction which can exceed the torque of said input means, said torque intensifier housing portion together with one of said first and second output means receives a turning force in one direction while the other one of said first and second output means receives an equal turning force in the opposite direction at a lower speed but higher torque than said input means, and so that one of said first and second output means turns in said one mode and in said another mode while the other of said first and second output means turns in said one mode and reacts in said another mode.

In the inventive tool in order for the housing, the gears of the torque intensifier and the input- and output means to turn in the same direction at the same speed, the usual equal and opposite turning of parts has to be blocked temporarily. This can be done in many way. For example, one can block the gears so that they cannot freely turn in the housing, or one blocks the planet gears so that the sun gear cannot turn them, or one blocks the housing and the output shaft so that they cannot turn independently from one another, or one blocks the action drive and the reaction drive or their attachment, or one blocks one part of the fastener with the other if both are to be turned down together and then turned independently from one another, etc.

To achieve the same result without turning the housing, the gears and the output and input shaft together would be quite complex simply because one would have to cut out all or at least all but one gear cage temporarily, whereas in accordance with the present invention the entire intensifier housing is cut off temporarily by merely blocking two usually opposite turning parts.

With the tool in accordance with the present invention, during turning of one part of the threaded connector such as a nut and applying an action force, a reaction force can be compensated by reacting against a neighboring object for example against a neighboring nut, against another part of the threaded connector for example a washer, against a further part of the threaded connector for example a sleeve, etc.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1 and 1*b* are views showing a torque intensifying tool for tightening and loosening threaded connectors in accordance with one embodiment of the present invention, wherein FIG. 1*a* is a view showing the tool in one mode of operation and FIG. 1*b* is a view showing the tool in another mode of operation;

FIG. 2*a*-2*c* are views showing a torque intensifying tool in accordance with another embodiment of the present invention, wherein FIG. 2*a* is a view showing the tool in one mode of operation, FIG. 2*b* is a view showing the tool in another mode of operation, and FIG. 2*c* showing a tool end;

DESCRIPTION OF THE PREFERRED EMBODIMENTS

Figure 1A:
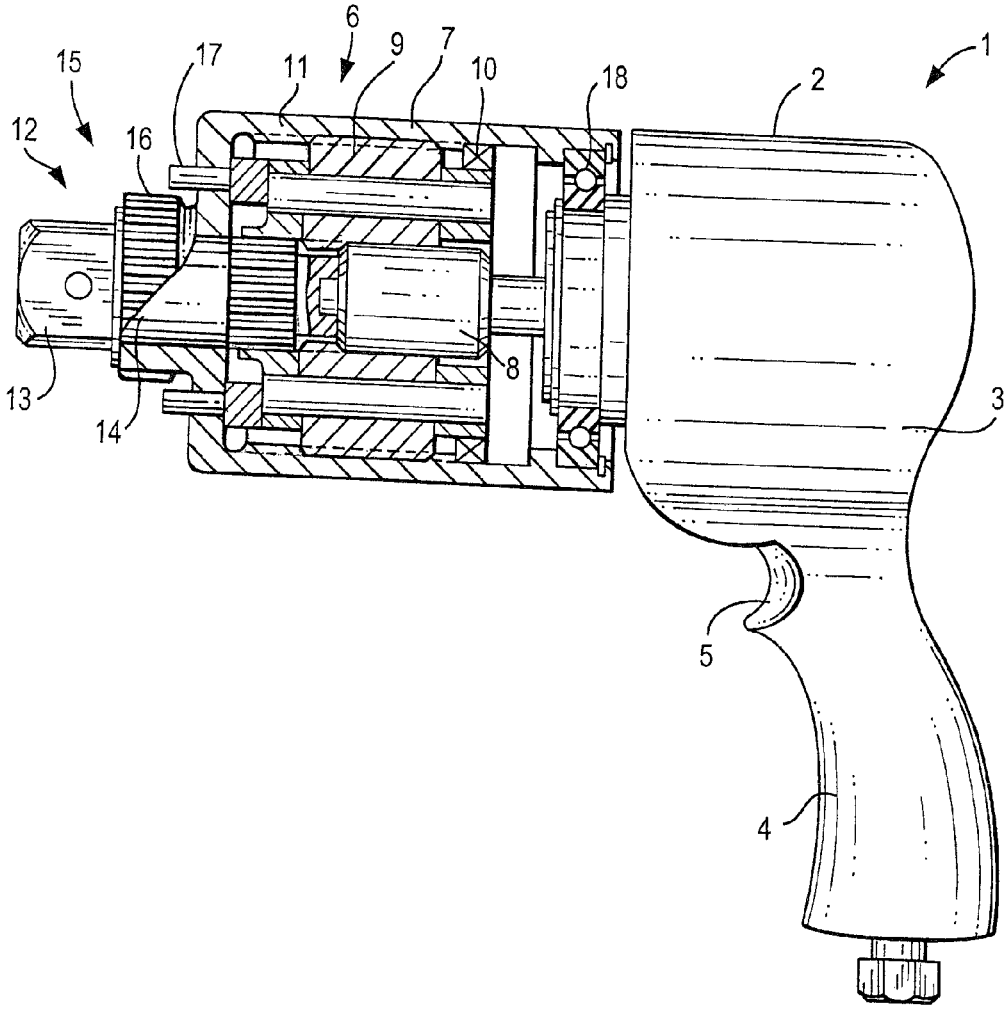

A torque intensifying tool for tightening and loosening threaded connectors has drive means which are identified as a whole with reference numeral 1. The drive means 1 can have a drive housing 2 and a drive which is identified with reference numeral 3. The drive means 1 can be formed as a motor drive means, in which case it can include a motor. It is also possible that the drive means 1 is formed as manual drive means, for example as a torque wrench. The drive means 1 generate a torque which is to be transmitted for operation. In the embodiment shown in FIGS. 1*a*, 1*b* the drive housing 2 has a handle 4 which is to be held by an operator and provided with switching means 5 for switching the drive means between an inoperative position and an operative position.

The torque intensifying tool in accordance with the present invention further has at least one torque intensifier means which are identified as a whole with reference numeral 6. The torque intensifier means 6 have a torque intensifier housing 7 and gear means connected to the drive means 1. In the embodiment shown in FIGS. 1*a*, 1*b* the gear means include a sun gear 8 having a shaft which forms an input means, planetary gears 9 and a planet cage 10. The torque intensifier housing 7 is provided with an internal gear 11 which extends only over a longitudinal portion of the housing 7.

The torque intensifying tool in accordance with the present invention further has a driving element which is identified as a whole with reference numeral 12 and forms a first output means. The driving element 12 has a driving part 13 which can be formed for example as a square drive and a rear part 14 which is drivingly connected with the torque intensifier means, for example by interengaging splines. The connection of the drive means 1 with the torque intensifier means 6 and the driving element 12 provides transmission of torque from the drive means to the driving element. The torque intensifier means 6 can be configured to provide any desired intensification of a torque generated by the drive means 1.

The torque intensifying tool further has a reaction element which is identified with reference numeral 15 and forms a second output means. The reaction element 15 is provided with means 16 for connecting with an element reacting against a stationary object, for example a reaction arm, for example with splines. The reaction element 15 is non rotatably connected with the torque intensifier housing 7. In the embodiment shown in FIGS. 1*a* and 1*b*, the reaction element 15 is formed integral one-piece with the torque intensifier housing.

The torque intensifying tool has two different modes of operation. In one mode of operation when the torque is transmitted from the drive means 1 through the torque intensifier means to the driving element 12 the driving element 12 provides a lower torque and a higher speed of turning. This is advantageous when it is necessary to turn one part of the threaded connector, for example a nut, on another part of the threaded connector, for example a bolt, with a high speed until the nut is seated on a washer or on the face of an application. In this mode of operation the torque is transmitted from the drive means, through the torque intensifier housing 7, the gears of the torque intensifier, the second output means or the reaction element 15, and the first output means or the driving element 12, so that the torque intensifier housing 7 together with the first output means and the second output means turn in the same direction and at the same torque and speed as the input means.

In another mode of operation the torque is transmitted from the drive means 1 through the torque intensifier means to the driving element 12 so that the torque intensifier housing 7 together with the second output means or the reaction element 15 receives a turning force in one direction, while the first output means or the driving element 12 receives an equal turning force in the opposite direction at a lower speed but higher torque then the input means.

Figure 1B:
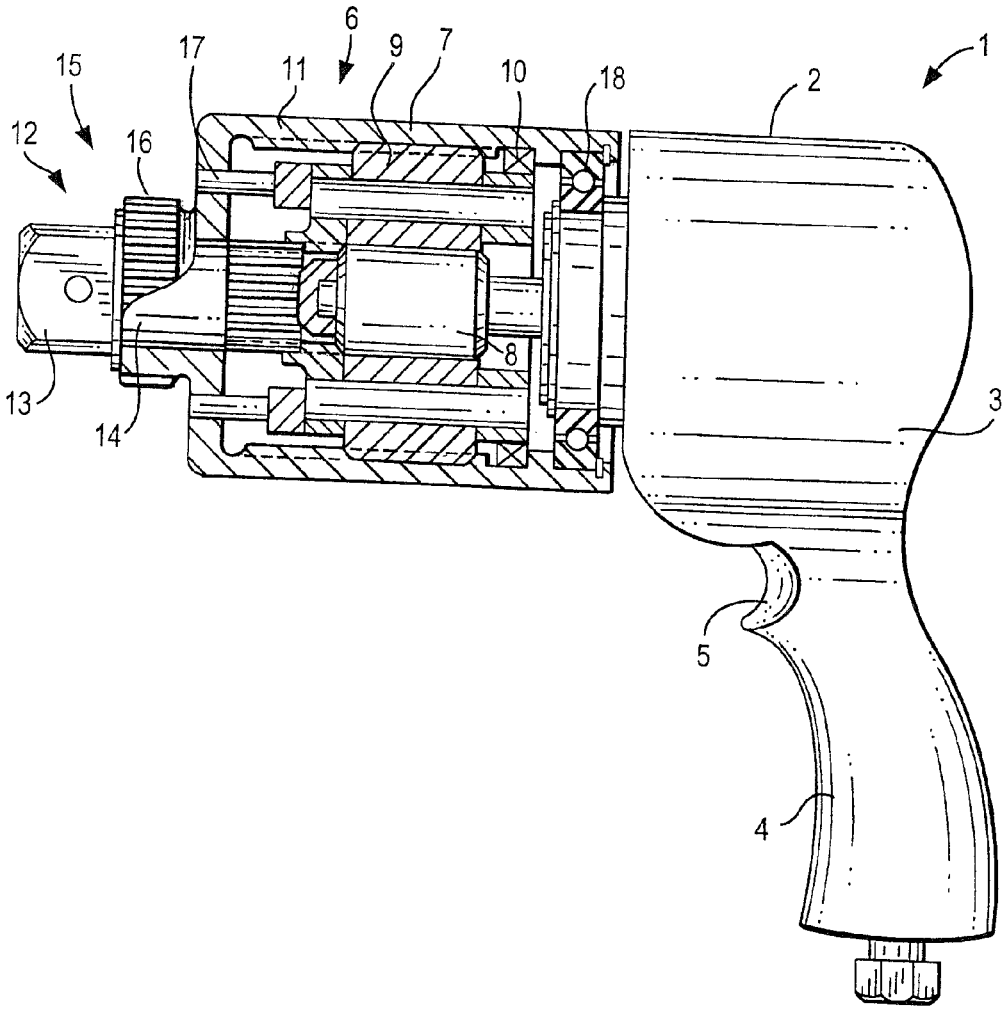

For switching the tool between these two different modes, in the embodiment shown in FIGS. 1*a*, 1*b* for example pushing elements 17, formed as pins and the like are provided. When the nut is seated on the washer, the pushing elements 17, which in FIG. 1*a* illustrating one mode of operation extend outwardly beyond the torque intensifier housing 7, are pushed in an axial direction as shown in FIG. 1*b*, and the planet cage 10 which was previously engaged with the internal gear 11 of the torque intensifier housing 7 disengages from the internal gear, so that the first output means or the driving element 12 and the second output means or the reaction element 15 can turn in opposite directions. It is to be understood that different means for switching between two different modes of operation are possible.

In accordance with the present invention in the torque intensifying tool the torque intensifier housing 7 and the drive housing 2 are functionally connected with one another. In particular, the torque intensifier housing 7 can turn relative to the drive housing 2. For this purpose, as shown in FIGS. 1*a*, 1*b*, a part of the drive housing 2, which can contain additional torque intensifier means, can extend into the torque intensifier housing 7 and be supported in the latter through a bearing 18. With this construction, the torque intensifier housing 7 can freely turn relative to the drive housing 2. The drive housing 2 can be formed as an enclosure, as a support, as a frame, etc. for the drive. This also can be done by a switch automatically once the torque required exceeds a given force.

Figure 2A:
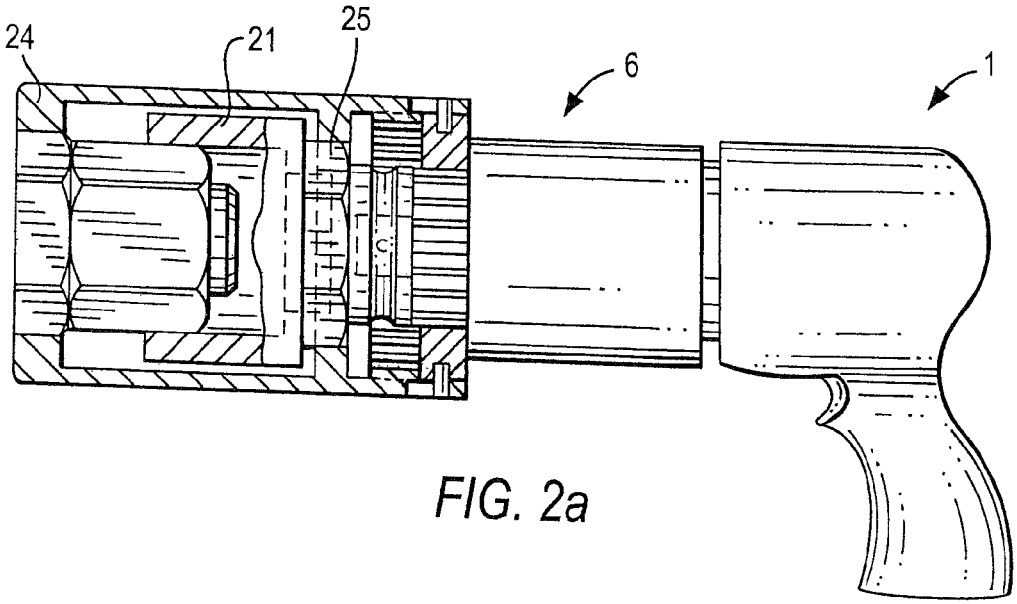
Figure 2B:
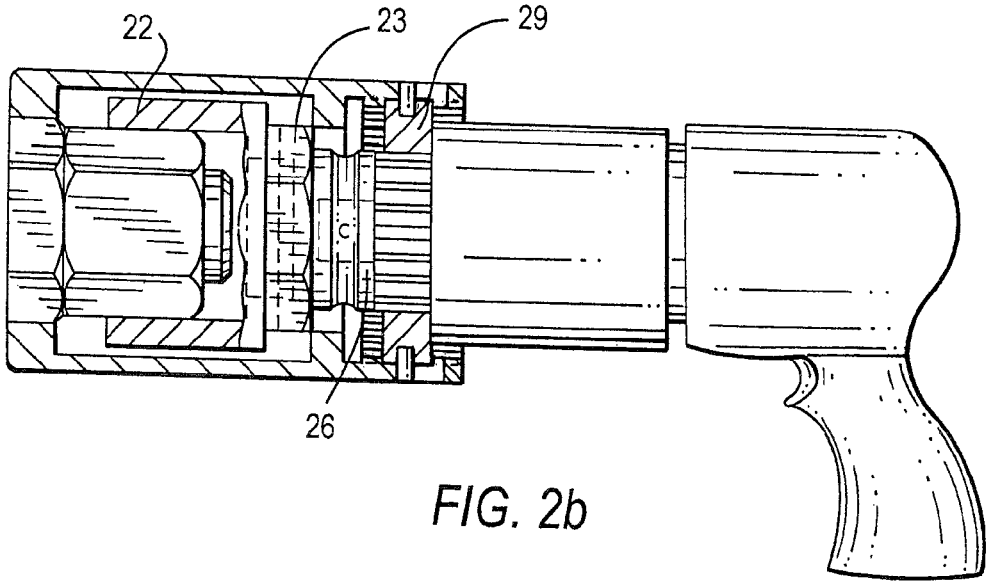
Figure 2C:
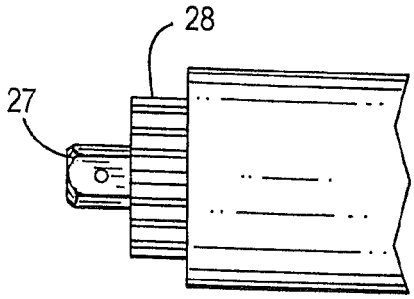

In another embodiment of the present invention which is shown in FIGS. 2*a*-2*c* the first output means is formed as a driving socket 21 which has a portion 22 with a polygonal inner surface to engage the nut and a portion 23 with a polygonal outer shape. The second output means is also formed as a reaction socket having a portion 24 with a polygonal shape for engaging a neighboring object, for example a washer, and a portion 25 with an inner polygonal opening configured to cooperate with the polygonal portion 23 of the driving socket. The driving socket has a receiving opening 26 in which a square drive 27 of a tool can be received. A spline portion 28 of the tool is received in an inwardly spline adaptor 29 which is non-rotatably connected with the reaction socket.

The driving socket is axially movable relative to the reaction socket. For one mode of operation the portion 23 of the driving socket engages in the portion 25 of the reaction socket so that the sockets become non-rotatably connected with one another as shown in FIG. 2*a* and the torque of the drive means 1 is transmitted through the torque intensifier to the driving socket at the same speed and torque as the input means. In this mode the first and second output means turn.

When as shown in FIG. 2*b* the driving socket is axially displaced for example so that its portion 23 is disengaged from the portion 25 of the reaction socket, the driving socket and the reaction socket are no longer non-rotatably connected with one another in the other mode of operation and they turn in opposite directions with equal turning forces at a lower speed but higher torque than the input means. In this mode the first output means or the driving socket turn, while the second output means or the reaction socket reacts.

In this embodiment in one mode of operation the torque intensifier housing together with the driving socket and reaction socket turn in the same direction and at the same speed and torque as the input means, wherein in the other mode of operation the torque intensifier housing together the reaction socket receives a turning force in one direction while the driving socket receives the turning force in the opposite direction.

It is to be understood that in the other mode the first and second output means can both act as driving means or reaction means in opposite directions depending on application.

Figure 3:
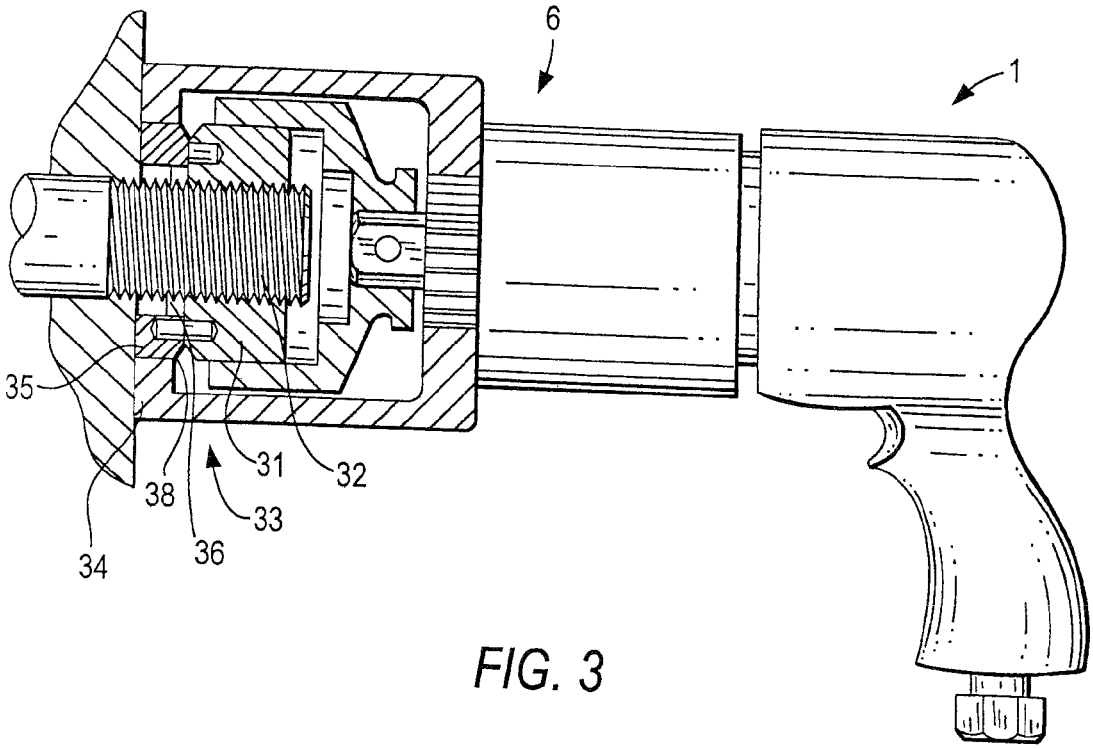
FIG. 3 is a view showing a torque intensifying tool for tightening and loosening threaded connectors in accordance with a further embodiment of the present invention.

In the embodiment shown in FIG. 3 a nut to be tightened or loosened is identified with reference numeral 31, a bolt on which the nut is to be tightened or loosened is identified with reference numeral 32, and a washer is identified with reference numeral 33 and has a radially outer holding portion 34 and a radially inner portion 35 engageable with the bolt 32. Means is provided for transmitting torque in the two modes of operation. They can be formed for example as connecting pins 36 which engage in aligned openings 38 of the nut and the washer.

In one mode of operation the pins 36 non-rotatably connect the nut with the washer so that they turn together with the same speed and torque as the input means. After the nut is seated on the washer, and a torque increases, the pins 36 are disintegrated, for example sheared off, so that the nut is turned with a higher torque and a lower speed than the input means while the washer provides a reaction.

It is to be understood that the at least two modes as described herein are merely examples. Further modes can be added to said one or said other modes and/or said input means and/or output means.

Figure 4A:
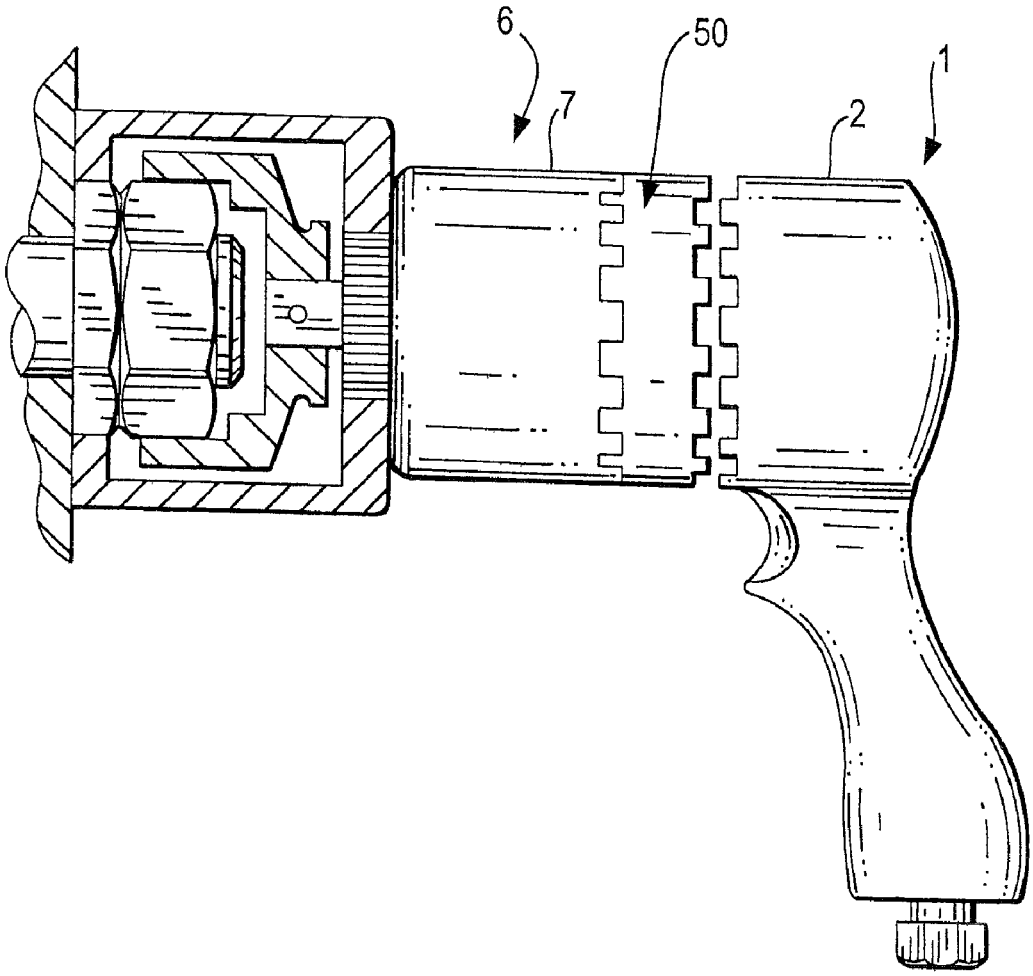
FIGS. 4*a*-4*b* are views showing another embodiment of the inventive torque intensifying tool in two different modes of operation.
Figure 4B:
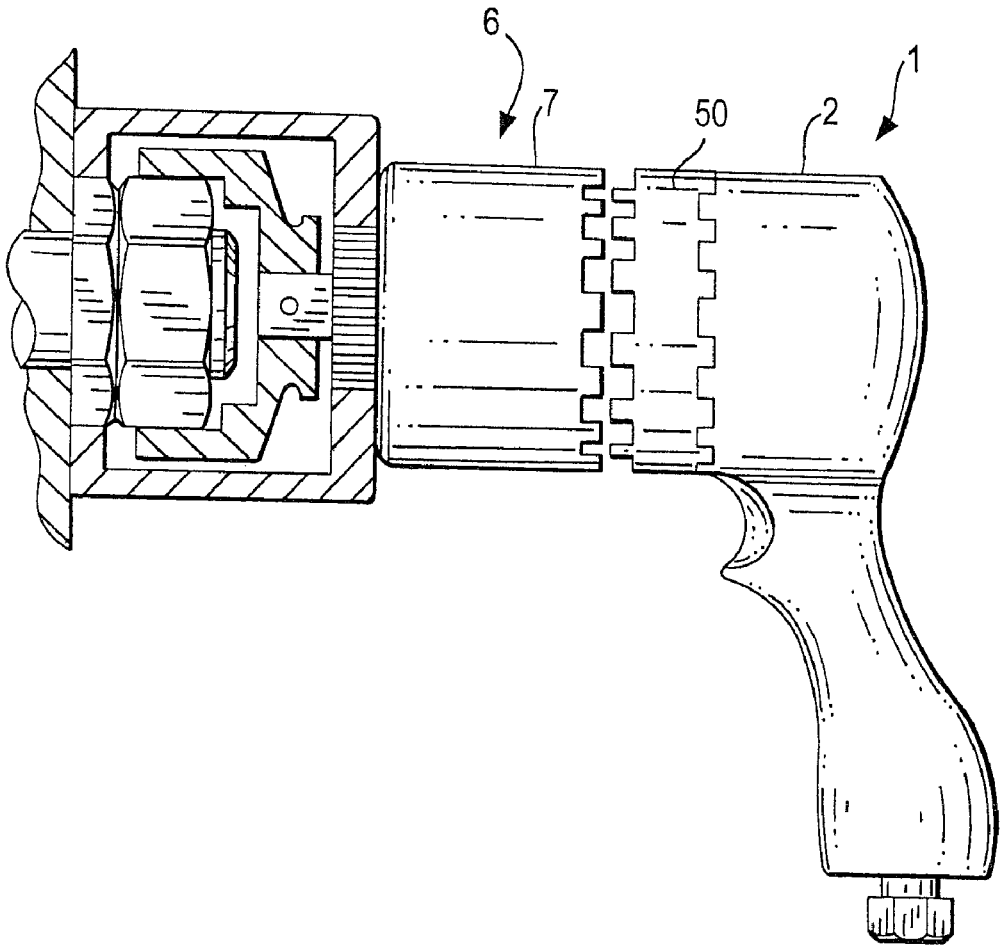

While the torque intensifying tool described hereinabove is a two speed tool, the present invention is not limited to merely two speeds but can have multiple speeds, as shown for example in FIGS. 4*a*, 4*b*. For example the drive operatively connected with the input means of the torque intensifier means can be configured as an intermediate drive housing 50 so that the drive includes for example the drive housing 2 and the intermediate drive housing 50.

When two usually opposite turning parts are temporarily connected with one another in the torque intensifier means or at an end thereof and the intermediate drive housing 50, which contains at least one intensifier unit such as for example a planetary gear stage, is connected with the torque intensifier housing so as not to rotate relative to it a), the turning of the torque intensifier housing together with the first and second output means is at a speed and torque of what is derived from the drive housing portion 2. When the torque required to turn the fastener exceeds that torque derived from the drive housing 2 and the intermediate drive housing 50 is non-rotatably connected with the drive housing 2 b), and rotatably connected with the torque intensifier housing, the turning of the torque intensifier housing 7 together with the first and second output means is at a lower speed but higher torque of what is derived from the drive housing 2. When the turning friction of the fastener is such that the tool switches from one mode to another, the torque applied to the fastener is one more times increased while the turning speed is further decreased. In FIG. 4*a* the intermediate drive housing portion 50 is non-rotatably connected with the torque intensifier housing 7, while in FIG. 4*b* the intermediate drive housing 50 is non-rotatably connected with the drive housing 2.

It should also be mentioned that the torque intensifier is not limited just to planetary gears. It can also be composed of any type of mechanisms that increase the torque output relative to the torque input.

It will be understood that each of the elements described above, or two or more together, may also find a useful application in other types of constructions differing from the types described above.

While the invention has been illustrated and described as embodied in a motor-driven torque intensifier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A torque intensifying tool for tightening and loosening threaded connectors, comprising drive means; at least one torque intensifier means receiving a torque from said drive means and having gear means and a torque intensifier housing portion; a driving element turning one part of a threaded connector; a reaction element reacting against a neighboring object during the turning of the one part of the threaded connector by said driving element; and means switching the torque intensifying tool between two modes of operation and configured so that in one mode of operation said driving element turning one part of the threaded connector operates with a high speed and a low torque and said torque intensifier housing portion is connected with said driving element turning one part of the threaded connector and said reaction element reacting against the neighboring object and said torque intensifier housing portion together with said driving element turning one part of the threaded connector and said reaction element reacting against the neighboring object turn in one direction, and in another mode of operation said driving element turning one part of the threaded connector operates with a low speed and a high torque and said torque intensifier housing portion together with said reaction element reacting against the neighboring object is disconnected from said driving element turning one part of the threaded connector so that in the other mode of operation said torque intensifier housing portion together with said reaction element reacting against the neighboring object receives a turning force in an opposite direction while said driving element turning one part of the threaded connector receives an equal turning force in the one direction, and so that said driving element turning one part of the threaded connector turns in said one mode and in said another mode while said reaction element reacting against the neighboring object turns in said one mode and reacts in said another mode.

2. A torque intensifying tool as defined in claim 1, wherein said driving element turning one part of the threaded connector is configured as a driving socket for turning one part of the threaded connector, whereas said reaction element reacting against the neighboring object is configured as a reaction socket for reacting during the turning of the one part of the threaded connector, so that in the other mode of operation said torque intensifier housing portion receives a turning force together with said reaction socket while said driving socket receives an equal opposite turning force.

3. A torque intensifying tool as defined in claim 1; and further comprising at least one drive housing portion; and means for functionally connecting said torque intensifier housing portion and said drive housing portion with one another so that said housing portions are turnable relative to one another.

4. A torque intensifying tool as defined in claim 3; and further comprising an intermediate drive housing portion to provide at least three speeds of operation, including a high speed low torque in said one mode when said intermediate drive housing portion is rotatably connected with said at least one drive housing portion and non-rotatably connected with said torque intensifier housing portion, a medium speed higher torque in said one mode when said intermediate drive housing portion is rotatably connected with said at least one drive housing portion and rotatably connected with said torque intensifier housing portion, and at a low speed and highest torque in said another mode when the tool switches from one mode to another.

5. A torque intensifying tool as defined in claim 4, wherein a shifting from one speed to another is automatic.

6. A torque intensifying tool as defined in claim 1, wherein said intensifier housing portion is formed of one piece with said reaction element.

7. A torque intensifying tool as defined in claim 1, wherein said intensifier housing portion is connected with said reaction element through connecting means.

8. A torque intensifying tool as defined in claim 1; and further comprising means for connecting one part of the threaded connector to another part of the threaded connector and is configured so as to be integral one-piece in said one mode of operation and to disconnect the parts of the threaded connector from one another to be a two-piece configuration in said another mode of operation.

9. A torque intensifying tool as defined in claim 1, wherein said means for switching from the one mode of operation to the other mode of operation and vise versa is configured so that said means for switching operate automatically when the one part of the threaded connector is seated on another part of the threaded connector.

10. A torque intensifying tool as defined in claim 1, wherein said means for switching from the one mode of operation to the other mode of operation and vice versa is provided with a switch which operates when the one part of the threaded connector is seated on another part of the threaded connector.

11. A torque intensifying tool as defined in claim 1, wherein said means for switching from the one mode of operation to the other mode of operation and vice versa is configured so that it operates by means of moving the tool in an axial direction of the threaded fastener when the one part of the threaded connector is seated on another part of the threaded connector.

12. A torque intensifying tool as defined in claim 1, wherein said drive is configured as a hand torque tool.

13. A torque intensifying tool as defined in claim 1, wherein said drive includes a motor with a motor housing.

14. A torque intensifying tool as defined in claim 1, wherein said drive includes a motor and at least one intensifier to increase an output torque of said drive.

15. A torque intensifying tool as defined in claim 14, wherein said at least one torque intensifier is configured so as to limit the output torque of said drive so that its reaction force is absorbable by an operator.

16. A torque intensifying tool as defined in claim 1, wherein said drive includes a motor-operated torque tool.

* * * * *